US011210927B2

(12) United States Patent
Kybarshi et al.

(10) Patent No.: US 11,210,927 B2
(45) Date of Patent: Dec. 28, 2021

(54) METHOD AND A SYSTEM FOR ENABLING USER/S TO TRIGGER AN ALARM

(71) Applicant: Carrier Corporation, Palm Beach Gardens, FL (US)

(72) Inventors: Eranna Kybarshi, Hyderabad (IN); Ramana Babu Kalagani, Hyderabad (IN); Ramesh Ganapuram, Hyderabad (IN); DL Sirisha Challa, Hyderabad (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/095,150

(22) Filed: Nov. 11, 2020

(65) Prior Publication Data

US 2021/0142651 A1 May 13, 2021

(30) Foreign Application Priority Data

Nov. 13, 2019 (IN) ..... 201911046176

(51) Int. Cl.
*G08B 25/00* (2006.01)
*G08B 25/01* (2006.01)
*G08B 25/10* (2006.01)

(52) U.S. Cl.
CPC ..... *G08B 25/016* (2013.01); *G08B 25/003* (2013.01); *G08B 25/007* (2013.01); *G08B 25/10* (2013.01)

(58) Field of Classification Search
CPC .... G08B 25/016; G08B 25/10; G08B 25/007; G08B 25/003
See application file for complete search history.

(56) References Cited

U.S. PATENT DOCUMENTS

| | | | | |
|---|---|---|---|---|
| 6,040,769 | A | 3/2000 | Payne | |
| 9,183,731 | B1 | 11/2015 | Bokhary | |
| 2011/0140882 | A1* | 6/2011 | Jang | G08B 25/10 340/539.13 |
| 2014/0062693 | A1* | 3/2014 | Watts | G08B 25/08 340/539.11 |
| 2014/0120950 | A1* | 5/2014 | Fulton | G01S 19/46 455/456.1 |

(Continued)

FOREIGN PATENT DOCUMENTS

| | | | | |
|---|---|---|---|---|
| EP | 3291194 | A1 * | 3/2018 | G08B 25/10 |
| EP | 3547280 | A1 | 10/2019 | |
| KR | 2006028253 | A | 11/2015 | |

OTHER PUBLICATIONS

European Search Report for Application No. 20203162.1; dated Apr. 7, 2021; 10 Pages.

*Primary Examiner* — Ojiako K Nwugo
(74) *Attorney, Agent, or Firm* — Cantor Colburn LLP

(57) ABSTRACT

A system and method for enabling a user to trigger an alarm. A method includes receiving a command from a user to trigger an alarm, the user provides the command through an interface of a user device and converting the command to an alarm signal. The method further includes determining a location of the user device and transmitting the location and the alarm signal to one or more devices, wherein the one or more devices transmit the location and the alarm signal to a control panel for notifying a facility regarding the alarm.

19 Claims, 4 Drawing Sheets

(56) References Cited

U.S. PATENT DOCUMENTS

| | | | | |
|---|---|---|---|---|
| 2015/0084770 | A1* | 3/2015 | Xiao | G06F 16/951 340/540 |
| 2015/0279184 | A1 | 10/2015 | Kore et al. | |
| 2015/0310727 | A1* | 10/2015 | Beaulieu, Jr. | G08B 25/016 340/539.13 |
| 2018/0372833 | A1* | 12/2018 | Wen | G01S 19/17 |
| 2019/0043613 | A1* | 2/2019 | Gallagher | G16H 40/67 |

* cited by examiner

METHOD AND A SYSTEM FOR ENABLING USER/S TO TRIGGER AN ALARM

FOREIGN PRIORITY

This application claims priority to Indian Patent Application No. 201911046176, filed Nov. 13, 2019, and all the benefits accruing therefrom under 35 U.S.C. § 119, the contents of which in its entirety are herein incorporated by reference.

TECHNICAL FIELD OF INVENTION

The present invention generally relates to fire safety systems. More particularly, the invention relates to a system and a method for enabling a user to raise an alarm.

BACKGROUND OF THE INVENTION

Safety of people is of utmost importance and to save people from any untoward situation is a major concern. Over a period of time, several preventive measures have been taken to save people from any untoward incidents like smoke/fire breakouts. Such preventive measures may involve deploying several manual call points (MCPs) in a premises (e.g. building, floors, rooms, museums, hospitals, colleges etc.). Such manual call points may be used by the people to raise an alarm during the smoke/fire breakouts. In order to raise an alarm using the manual call points, a button may be pressed by a person provided in the manual call points or a glass provided in each of the manual call points may be broken by the person.

However, during the smoke/fire breakouts, it becomes difficult for the people to manually search for the manual call points and is also time consuming to the reach the manual call points for raising an alarm. Moreover, when a physically handicapped person is present during any such incident, it is not possible for such a person to reach any manual call point and raise an alarm. As of now, there is no solution available that provides an easy way for a person to raise an alarm during any untoward incident.

In view of the afore-mentioned problems in the existing solutions, there is a need of an efficient and effective system and a method for providing an easy way for a person to raise an alarm during any untoward incident. There is also a need to enable a person to raise an alarm during any untoward incident without using any manual call point. In order to solve the problems in the existing solutions, a system and a method are disclosed.

SUMMARY OF THE INVENTION

Various embodiments of the invention describe a system for enabling a user to raise an alarm. The system comprises a user device and one or more devices. The user device comprises an interface adapted to receive a command from a user to trigger an alarm and a converter unit adapted to convert the command to an alarm signal. The user device also comprises a location determination unit adapted to determine a location of the user device and a transmitter adapted to transmit the location and the alarm signal to one or more devices. The one or more devices comprise an embedded device adapted to receive the location and the alarm signal from the user device and a transmitter adapted to transmit the location and the alarm signal to a control panel for notifying a facility regarding the alarm.

In another embodiment of the invention, the interface receives the command from the user through an application stored in the user device on detecting a fire incident or smoke incident.

In a different embodiment of the invention, the one or more devices further comprises a detection unit and an impedance unit.

In an embodiment of the invention, the detection unit is adapted to detect a state of the impedance unit based on the location and the alarm signal.

In another embodiment of the invention, the state of the impedance unit is transmitted to a control panel for notifying a facility regarding an alarm.

In yet another embodiment of the invention, the user provides the command through the interface to trigger a fire alarm or a smoke alarm.

In still another embodiment of the invention, the location determination unit is adapted to determine the location of the user device using a global positioning system (GPS) or an indoor positioning system (IPS) associated with the user device.

In yet another embodiment of the invention, the location determination unit is adapted to determine the location of the user device using one or more beacons deployed near the user device.

In another embodiment of the invention, the location detection unit is adapted to determine the location of the user device based on an angle of arrival of a signal from the one or more beacons.

In an embodiment of the invention, the user device transmits the location and the alarm signal to the one or more devices through a first wireless communication channel. Further, the one or more devices transmit the location and the alarm signal to the control panel through a second wireless communication channel or a wired communication channel.

In another embodiment of the invention, the command received from the user is converted to the alarm signal if the command is valid.

In an embodiment of the invention, the interface of the user device is adapted to provide a notification to the user if the command is not valid.

In another embodiment of the invention, the one or more devices are fire devices or smoke devices deployed in a premises.

In yet another embodiment of the invention, the control panel notifies the facility regarding the alarm for taking an action to handle a fire incident or a smoke incident.

In an embodiment of the invention, the command received from the user is a voice command or a text command.

Various embodiments of the invention describe a method for enabling a user to raise an alarm. The method comprises steps of receiving a command from a user to trigger an alarm. The user provides the command through an interface of a user device and the command is converted to an alarm signal. The method further comprises steps of determining a location of the user device and transmitting the location and the alarm signal to one or more devices, wherein the one or more devices transmit the location and the alarm signal to a control panel for notifying a facility regarding the alarm.

In another embodiment of the invention, the user provides the command through the interface to trigger a fire alarm or a smoke alarm.

In a different embodiment of the invention, the user device determines the location of the user device using a global positioning system (GPS) or an indoor positioning system (IPS) associated with the user device.

In another different embodiment of the invention, a computer readable medium is disclosed for enabling a user to raise an alarm. The computer readable medium comprises one or more processors and a memory coupled to the one or more processors. The memory stores instructions executed by the one or more processors. The one or more processors are configured to receive a command from a user to trigger an alarm. The user provides the command to a user device and the command is converted to an alarm signal. The one or more processors are further configured to determine a location of the user device and transmit the location and the alarm signal to one or more devices. The one or more devices transmit the location and the alarm signal to a control panel for notifying a facility regarding the alarm.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Figure 1:
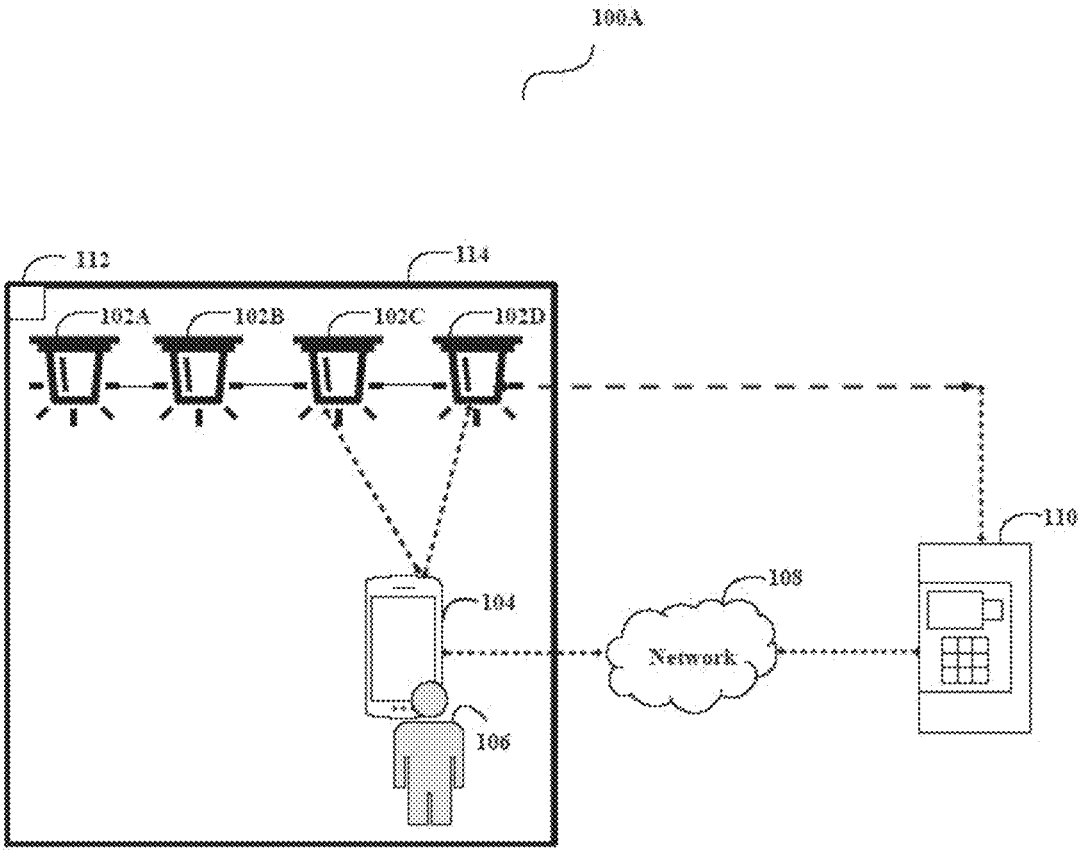
FIG. 1 depicts an exemplary system architecture according to an exemplary embodiment of the invention.

Described herein is the technology with a system and a method for enabling a user to raise an alarm. The user may be associated with a user device and the user device may have an application stored on the user device. The user may use the application to provide a command to trigger an alarm. The user device may validate the command. In case, the command is valid, the user device may convert the command to an alarm signal. The user device may also determine a location of the user device. The user device may transmit the location and the alarm signal to one or more devices. Accordingly, the one or more devices may communicate the location and the alarm signal received from the user device to a control panel for notifying a facility regarding the alarm. In an exemplary embodiment, the command received from a user may be a voice command or a text command.

As used herein, the user device may be communicably coupled with the one or more devices and/or the control panel through a wireless network. The user device may comprise, but is not limited to, an interface, a transmitter, a receiver, a validation unit, a converter unit, a location determination unit, a memory and/or a processor. The user device may be a desktop computer or a hand held device such as a mobile phone with network connectivity. Example of the user device includes a desktop, workstation PC, a laptop, a smart phone, a tablet, a wearable device and the like.

As used herein, the one or more devices may communicate with the control panel through a wired network or wireless network. Also, the one or more devices may be connected with each other in a loop. The one or more devices may comprise, but is not limited to, a transmitter, a receiver, a detection unit, an impedance unit, an embedded device, a memory and/or a processor. The one or more devices may be fire devices, smoke devices, temperature devices, or any such device that is obvious to a person skilled in the art.

As used herein, the control panel may be communicably connected with the one or more devices. The control panel may notify a facility regarding the alarm triggered by the user using the user device. In an exemplary embodiment, the control panel may be a fire alarm control panel (FACP), a fire alarm control unit (FACU), or a fire alarm panel.

As used herein, the facility may be a particular control room with a user terminal that may be notified by the control panel regarding the alarm. In an exemplary embodiment, the alarm triggered by the user may be a fire alarm or a smoke alarm. The control room may have a team of people who may take an action to handle a fire incident or a smoke incident.

As used herein, the network may refer to a wired network, a mesh network, any cellular network (e.g. Global System for Mobile (GSM) network, a Long-Term Evolution (LTE) network, a code-division multiple access (CDMA) network, a narrow-band internet of thing (NB-IoT) technique or category M1 technique), any short-range network (e.g. a bluetooth network, a WiFi network, a ZigBee network) or any such network/technique that is known in the art.

Throughout the specification, reference numeral 102 depicts one or more devices. The reference numerals 102A, 102B, 102C, 102D may be considered as a single device.

FIG. 1 depicts a system architecture 100 for enabling a user to trigger/raise an alarm, according to an exemplary embodiment of the invention. As depicted in FIG. 1, one or more devices 102 may be deployed in a premises 114. The premises 114 may be a building, a floor of the building or a room of a building. For an instance, each room may have 5 devices installed in a floor or each floor may have 50 devices installed in a building or a building may have 500 devices. Further, a user 106 may be associated with a user device 104 and may be present in the premises 114. Also, the one or more devices 102 may be communicably connected with a control panel 110 either through a wired network or a wireless network. Further, the control panel 110 may also be communicably connected with the user device 104 through a wireless network 108. In an exemplary embodiment, the one or more devices 102 may be fire detector devices, smoke detector devices, temperature detector devices or any such detector devices that is well known in the art.

When the user 106 notices/detects a fire incident or smoke incident in the premises 114, the user 106 may input command/s to the user device 104 for triggering an alarm to notify a person or a facility regarding the fire incident or the smoke incident in the premises 114. For this, the user 106 may open an application stored in the user device 104 and then may input the command/s in an interface of the application. In an exemplary embodiment, the user 106 may input a voice command or a text command. Such an application may be provided by a manufacturer of the one or more devices 102, a manufacturer of the control panel 110 or an owner of the premises 114. In an exemplary embodiment, the commands inputted by the user 106 may be "Fire", "Smoke", "Fire at first Floor", "Fire in Room no. 2 at first Floor", "Smoke in server room", "Help", "Emergency", "Accident", "Mis-happening", "Fire in cafeteria" etc. These are the few examples of the command/s and any other variations in the command/s is within the scope of the present invention. Also, any such examples of the command in any other language (including local languages) are within the scope of the present invention. As used herein, the user 106 may be a visitor of the premises 114, an employee of the premises 114, a security member of the premises 114, a trained Single Point of Contact (SPOC) of the premises 114, a building management system (BMS) team member of the premises 114, or any such authorized person of the premises 114. This embodiment of the present invention provides a technical advantage of enabling a handicapped person to raise an alarm during any untoward incident and providing an easy way for any person to raise an alarm during any untoward incident by using simple voice or a text command/s.

When the user device 104 receives the command/s from the user 106 for triggering the alarm to notify a person or a facility, the user device 104 may determine a validity of the command/s. In order to determine the validity of the command/s, the user device 104 may check if the command/s received from the user 106 include any word from a list of a pre-defined words. In an exemplary embodiment, the list of a pre-defined words may be fire, smoke, burn, danger, emergency etc. Such a list of a pre-defined words may be defined by a manufacturer of the one or more devices 102 or a manufacturer of the control panel 110 or an owner of the premises 114. When the command/s received from the user 106 do not include any word from the list of the pre-defined words, then the user device 104 may determine that the command/s received from the user 106 is not valid. The user device 104 may notify the user 106 regarding the invalidity of the command/s and the user 106 may again provide a command/s to the user device 104. And, if the command/s received from the user 106 includes any word from the list of the pre-defined words, then the user device 104 may determine that the command/s received from the user 106 is valid. And if the commands is valid, the user device 104 may convert the command/s received from the user 106 to an alarm signal. The conversion of the command/s to the alarm signal (i.e. electrical signal) may be performed by well-known techniques in the art.

The user device 104 may also determine a location of the user device 104 where the user 106 is present in the premises 114. In an exemplary embodiment, the user device 104 may determine the location of the user device 104 using a global positioning system (GPS) of the user device 104 that is well known in the art. In another exemplary embodiment, the user device 104 may determine the location of the user device 104 using an indoor positioning system (IPS) associated with the user device 104 that is well known in the art. For this, the user device 104 may have a pre-stored map of the premises 114 that may be used to determine the location of the user device 104.

In a different exemplary embodiment, the user device 104 may determine the location of the user device 104 using one or more beacons 112 deployed near the user device 104. In an exemplary embodiment, the one or more beacons 112 are bluetooth beacons. The one or more beacons 112 may be present in the premises 114 where the user device 104 may be present. The one or more beacons 112 may broadcast signal/s inside the premises 114. The signal/s may be in the form of advertisement/s. The user device 104 may detect the signal/s broadcasted by the one or more beacons 112 and may determine a location of the user device 104 based on the signal/s. The location of the user device 104 using the signals may be determined based on an angle of arrival of the signal from the one or more beacons 112 as known to a person skilled in the art.

Moreover, the user device 104 may determine an identifier associated with the user device 104. Such an identifier may be a unique number for identifying the user device 104. The identifier associated with the user device 104 may be a media access control address (MAC address), a mobile number, an application identifier through which the user 106 inputs the commands, or any such identifier associated with the user device 104.

Then, the user device 104 may transmit the location, the alarm signal and the identifier associated with the user device 104 to the one or more devices 102 through a first wireless communication channel of a wireless network. In specific, an embedded device communicably coupled with each of the one or more devices 102 may receive the location, the alarm signal and the identifier from the user device 104. Also, the embedded device has a capability to enable the one or more devices 102 for receiving the location, the alarm signal and the identifier from the user device 104. In an exemplary embodiment, the embedded device may be attached to the each of the one or more devices 102 either wirelessly or through wires using a network. In another exemplary embodiment, the embedded device may be attached as a universal serial bus (USB) to the each of the one or more devices 102. In a different exemplary embodiment, the embedded device may be embedded in the each of the one or more devices 102 as a software or an electronic circuitry.

Moreover, the one or more devices 102 may comprise a detection unit and an impedance unit. The detection unit may determine a state of the impedance unit based on the identifier, the location and the alarm signal received from the user device 104. On receiving the identifier, the location and the alarm signal from the user device 104, the detection unit may extract the identifier associated with the user device 104 to identify a person who is sending the command/s. After processing the received information, the detection unit may provide conduction of electric current to the impedance unit thereby changing the impedance of the impedance unit. In particular, based on the identifier, the location and/or the alarm signal, the embedded device may change the resistance/impedance using a resistance/impedance switching network. Whenever the embedded device change its resistance, the change in a state of the resistance/impedance may be communicated to a control panel 110 indicating a warning for the alarm. The fire device change its status based on input resistance. The resistance values shall be different based on manufacturer and a type of the one or more devices 102.

The state of change in the impedance of the impedance unit may be communicated to a control panel 110 indicating a warning for the alarm. For an instance, if the detection unit identifies that an employee has sent has a command to trigger an alarm, then detection unit may detect a state of the impedance unit as a "warning state". Also, if the detection unit identifies that a security member, a trained Single Point of Contact (SPOC), or a building management system (BMS) team member has sent has a command, then detection unit may detect a state of the impedance unit as an "alarm state". Depending upon the identifier associated with the user device 104, the detection unit may detect a state of the impedance unit. Further, if a command is first sent by the employee and then another command is sent by the security member, the detection unit may change a state of the impedance from a "warning state" to an "alarm state". However, if the command is first sent by the security member and then the employee send the command, in such a case, the detection unit may not change a state of the impedance from an "alarm state" to a "warning state". Although, a limited number of states have been explained herein, however, any other possible state is within the scope of the present invention.

The location, the alarm signal and the state of the impedance unit may be transmitted by the one or more devices 102 to the control panel 110 through a second wireless communication channel or a wired communication channel using a network. On receiving the location, the alarm signal and the state of the impedance unit, the control panel 110 may notify (may be a pop-up notification) the facility regarding the alarm triggered by the user 106. Accordingly, an action can be taken by a team or people to handle the fire incident or the smoke incident. Such an action may be evacuation of the premises 114 etc. This embodiment of the present invention provides a technical advantage of providing a fast and less time-consuming solution in any untoward incident.

The present invention also facilitates the user 106 to capture a video or an image of the fire incident or the smoke incident in the premises 114 and may transmit the captured video or the image of the fire incident or the smoke incident to the one or more devices 102 using the user device 104. For this, the user 106 may use a camera of the user device 104 through the application and then transmit the captured video or the image to the one or more devices 102. When the facility receives the captured video or the image, the facility may analyze such captured video or the image for taking an appropriate action to handle the fire incident or the smoke incident in the premises 114. This embodiment of the present invention provides a technical advantage of easy identification of the user 106 who has raised an alarm.

Figure 2:
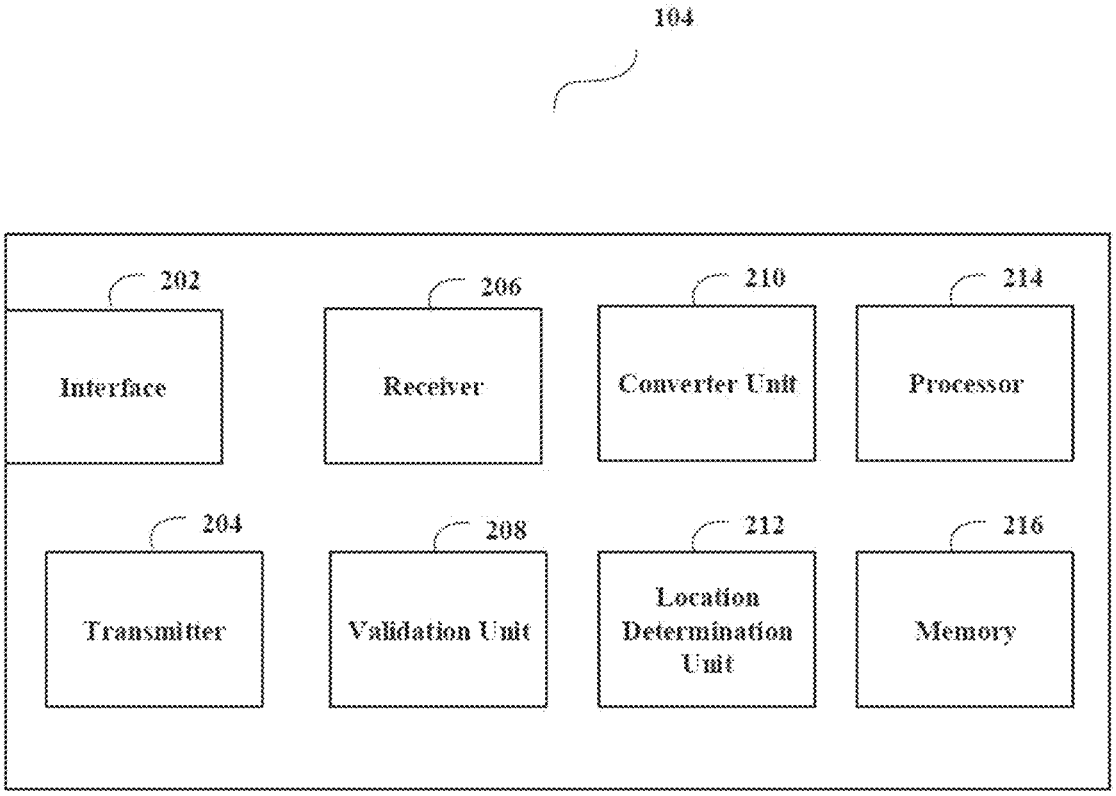
FIG. 2 depicts block diagram of different components of a user device according to an exemplary embodiment of the invention.

FIG. 2 depicts a block diagram of different components of a user device 104 according to an exemplary embodiment of the invention. The user device 104 may comprise, but is not limited to, an interface 202, a transmitter 204, a receiver 206, a validation unit 208, a converter unit 210, a location determination unit 212, a processor 214 and/or a memory 216. The interface 202 may be adapted to receive a voice or text command/s from a user 106 for triggering an alarm when the user 106 notices/detects a fire incident or smoke incident in a premises 114. The interface 202 may communicate the command/s to the validation unit 208. The validation unit 208 may validate the command/s as explained in FIG. 1 above. If the command/s is valid, the validation unit 208 may communicate the command/s to the converter unit 210. If the command/s is not valid, the validation unit 208 may communicate to the interface 202 regarding the invalidity of the command/s. The interface 202 may be adapted to notify the user 106 regarding the invalidity of the command/s. The converter unit 210 may be adapted to convert the command/s to an alarm signal. Also, the location determination unit 212 may be adapted to determine a location of the user device 104 as explained in FIG. 1 above. The transmitter 204 may be adapted to transmit the location, the alarm signal and/or an identifier to one or more devices as explained in FIG. 1 above. The memory 216 may be adapted to store one or more applications, the location of the user device 104, the identifier.

Moreover, the interface 202, the transmitter 204, the receiver 206, the validation unit 208, the converter unit 210, the location determination unit 212, the memory 216 may be communicably coupled with the processor 214. The different units described herein are exemplary. The invention may be performed using one or more units. For example, the tasks executed by the interface 202, the transmitter 204, the receiver 206, the validation unit 208, the converter unit 210, the location determination unit 212, the memory 216 and/or the processor 214 may be performed by a single unit. Alternatively more number of units as described herein may be used to perform the invention.

Figure 3:
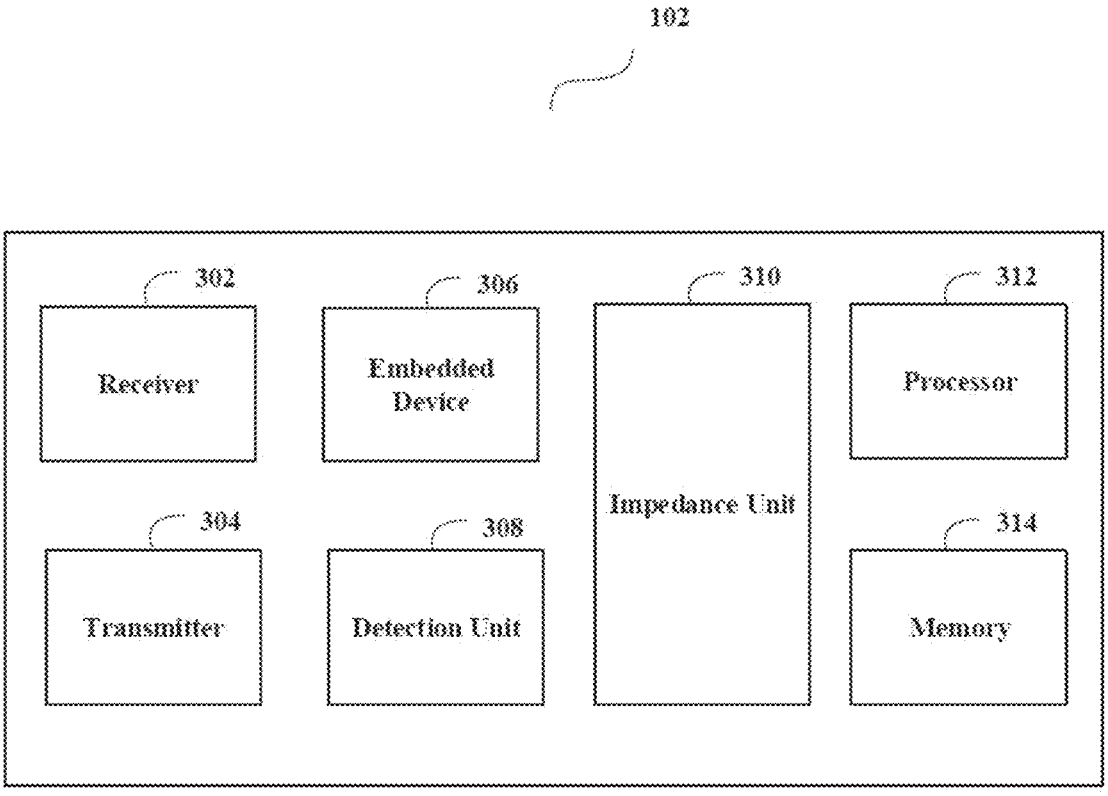
FIG. 3 depicts block diagram of different components of one or more devices according to an exemplary embodiment of the invention.

FIG. 3 depicts a block diagram of different components of one or devices 102 according to an exemplary embodiment of the invention. The one or devices 102 may comprise of, but is not limited to, a receiver 302, a transmitter 304, an embedded device 306, a detection unit 308, an impedance unit 310, a processor 312 and/or a memory 314. The embedded device 306 may be adapted to receive a location, an alarm signal and/or an identifier from a user device 104 through a first wireless communication channel using a network. The detection unit 308 may be adapted to determine a state of the impedance unit 310 based on the identifier received from the user device 104 as described in FIG. 1 above. The transmitter 304 may be adapted to transmit the location, the alarm signal the state and/or the identifier to a control panel for notifying a facility regarding the alarm through a second wireless communication channel or a wired channel using a network. The memory 314 may be adapted to store the location, the alarm signal the state of the impedance unit 310 and/or the identifier.

Moreover, the receiver 302, the transmitter 304, the embedded device 306, the detection unit 308, the impedance unit 310 and/or the memory 314 may be communicably coupled with the processor 312. The different units described herein are exemplary. The invention may be performed using one or more units. For example, the tasks executed by the receiver 302, the transmitter 304, the embedded device 306, the detection unit 308, the impedance unit 310 the memory 314 and/or the processor 312 may be performed by a single unit. Alternatively more number of units as described herein may be used to perform the invention.

Figure 4:
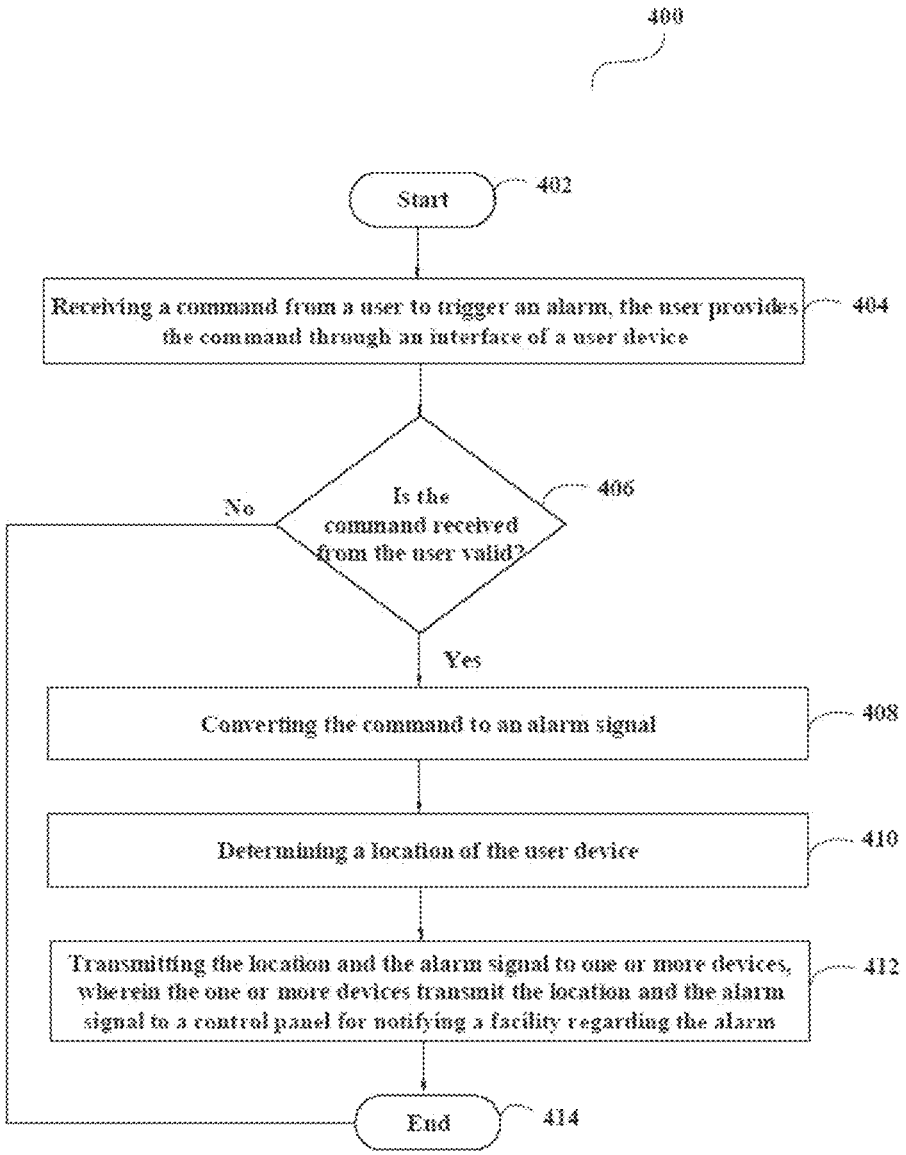
FIG. 4 depicts an exemplary flowchart illustrating a method to perform the invention according to an exemplary embodiment of the invention.

FIG. 4 depicts a flowchart outlining the features of the invention in an exemplary embodiment of the invention. The method flowchart 400 describes a method for enabling a user to trigger/raise an alarm. The method flowchart 400 starts at step 402.

At step 404, the user device 104 may receive command/s from a user 106 as discussed above. In an exemplary embodiment, the user 106 may input a voice command or a text command At step 406, the user device 104 may determine a validity of the command/s as discussed above. If the command/s is valid, then the method flowchart 400 may move to step 408 and if the command/s is not valid, then the method flowchart 400 may end at step 414.

At step 408, the user device 104 may convert the command/s received from the user 106 to an alarm signal as discussed above.

At step 410, the user device 104 may determine a location of the user device as discussed above in details.

At step 412, the user device 104 may transmit the location and the alarm signal to one or more devices 102 through a first wireless communication channel using a network. The one or more devices 102 may transmit the location and the alarm signal to a control panel 110 for notifying a facility regarding the alarm. Then, the method flowchart 400 may end at 414.

The present invention is applicable to various fields such as, but not limited to, malls, museums, libraries, colleges, universities, hospitals, offices and any such place or industry that is well known in the art and where the one or more devices 102 are used.

The embodiments of the invention and the tables discussed herein are exemplary and various modification and alterations to a person skilled in the art are within the scope of the invention.

In one embodiment of the invention, the invention can be operated using the one or more computer readable devices. The one or more computer readable devices can be associated with a user device 104. A computer readable medium comprises one or more processors and a memory coupled to the one or more processors, the memory stores instructions executed by the one or more processors. The one or more processors are configured to receive a command from a user 106 to trigger an alarm, the user 106 provides the command to a user device 104 and convert the command to an alarm signal. The one or more processors are also configured to determine a location of the user device 104 and transmit the location and the alarm signal to one or more devices 102, wherein the one or more devices 102 transmit the location and the alarm signal to a control panel 110 for notifying a facility regarding the alarm.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures/Tables and described herein. Other examples of the invention may include different computer-executable instructions or components having more or less functionality than illustrated and described herein. Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As is employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

In the subject specification, terms such as "data store," "data storage," "database," "cache," and substantially any other information storage component relevant to operation and functionality of a component, refer to "memory components," or entities embodied in a "memory" or components comprising the memory. It will be appreciated that the memory components, or computer-readable storage media, described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of."

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A system comprising:
a user device comprising:
an interface adapted to receive a command from a user to trigger an alarm;
a converter unit adapted to convert the command to an alarm signal;
a location determination unit adapted to determine a location of the user device; and
a transmitter adapted to transmit the location and the alarm signal to one or more devices; and
the one or more devices comprising:
an embedded device adapted to receive the location and the alarm signal from the user device; and
a transmitter adapted to transmit the location and the alarm signal to a control panel for notifying a facility regarding the alarm;
wherein the one or more devices further comprises a detection unit and an impedance unit.

2. The system of claim 1, wherein the interface receives the command from the user through an application stored in the user device on detecting a fire incident or smoke incident.

3. The system of claim 1, wherein the detection unit is adapted to detect a state of the impedance unit based on the location and the alarm signal.

4. The system of claim 3, wherein the state of the impedance unit is transmitted to a control panel for notifying the facility regarding an alarm.

5. The system of claim 1, wherein the user provides the command through the interface to trigger a fire alarm or a smoke alarm.

6. The system of claim 1, wherein the location determination unit is adapted to determine the location of the user device using a global positioning system (GPS) or an indoor positioning system (IPS) associated with the user device.

7. The system of claim 1, wherein the location determination unit is adapted to determine the location of the user device using one or more beacons deployed near the user device.

8. The system of claim 7, wherein the location detection unit is adapted to determine the location of the user device based on an angle of arrival of a signal from the one or more beacons.

9. The system of claim 1, wherein the user device transmits the location and the alarm signal to the one or more devices through a first wireless communication channel.

10. The system of claim 1, wherein the one or more devices transmit the location and the alarm signal to the control panel through a second wireless communication channel or a wired communication channel.

11. A system comprising:
a user device comprising:
an interface adapted to receive a command from a user to trigger an alarm;
a converter unit adapted to convert the command to an alarm signal;
a location determination unit adapted to determine a location of the user device; and
a transmitter adapted to transmit the location and the alarm signal to one or more devices; and
the one or more devices comprising:
an embedded device adapted to receive the location and the alarm signal from the user device; and
a transmitter adapted to transmit the location and the alarm signal to a control panel for notifying a facility regarding the alarm;
wherein the command received from the user is converted to the alarm signal if the command is valid.

12. A system comprising:
a user device comprising:
an interface adapted to receive a command from a user to trigger an alarm;
a converter unit adapted to convert the command to an alarm signal;
a location determination unit adapted to determine a location of the user device; and
a transmitter adapted to transmit the location and the alarm signal to one or more devices; and
the one or more devices comprising:
an embedded device adapted to receive the location and the alarm signal from the user device; and
a transmitter adapted to transmit the location and the alarm signal to a control panel for notifying a facility regarding the alarm;
wherein the interface of the user device is adapted to provide a notification to the user if the command is not valid.

13. The system of claim 1, wherein the one or more devices are fire devices or smoke devices deployed in a premises.

14. The system of claim 1, wherein the control panel notifies the facility regarding the alarm for taking an action to handle a fire incident or a smoke incident.

15. The system of claim 1, wherein the command received from the user is a voice command or a text command.

16. A method comprising:
receiving a command from a user to trigger an alarm, the user provides the command through an interface of a user device;
converting the command to an alarm signal;
determining a location of the user device; and
transmitting the location and the alarm signal to one or more devices, wherein the one or more devices transmit the location and the alarm signal to a control panel for notifying a facility regarding the alarm;

wherein the command received from the user is converted to the alarm signal if the command is valid.

17. The method of claim 16, wherein the user provides the command through the interface to trigger a fire alarm or a smoke alarm.

18. The method of claim 16, wherein the user device determines the location of the user device using a global positioning system (GPS) or an indoor positioning system (IPS) associated with the user device.

19. A computer readable medium comprising a non-transitory memory coupled to the one or more processors, the memory storing instructions are executed by the one or more processors, the one or more processors configured to:

receive a command from a user to trigger an alarm, the user provides the command to a user device;

convert the command to an alarm signal;

determine a location of the user device; and transmit the location and the alarm signal to one or more devices, wherein the one or more devices transmit the location and the alarm signal to a control panel for notifying a facility regarding the alarm;

wherein the command received from the user is converted to the alarm signal if the command is valid.

* * * * *